United States Patent [19]

Puchalski

[11] 4,003,313

[45] Jan. 18, 1977

[54] PROJECTILE

[75] Inventor: Walter J. Puchalski, Southampton, Pa.

[73] Assignee: The United States of America as represented by the Secretary of the Army, Washington, D.C.

[22] Filed: June 10, 1975

[21] Appl. No.: 585,649

[52] U.S. Cl. ..... 102/66; 102/60; 102/87

[51] Int. Cl.[2] ..... F42B 13/14; F42B 13/34

[58] Field of Search ..... 102/66, 60, 87

[56] References Cited

UNITED STATES PATENTS

| | | | |
|---|---|---|---|
| 2,093,353 | 9/1937 | Geitmann | 102/60 |
| 3,515,072 | 6/1970 | Barr | 102/87 |
| 3,677,181 | 7/1972 | Giljarhus et al. | 102/60 X |

FOREIGN PATENTS OR APPLICATIONS

| | | | |
|---|---|---|---|
| 888,604 | 1/1962 | United Kingdom | 102/60 |

*Primary Examiner*—Verlin R. Pendegrass
*Attorney, Agent, or Firm*—Nathan Edelberg

[57] ABSTRACT

A projectile having a conical wall interconnecting a rearwardly opening pyrotechnic cavity and the base of the projectile that is located substantially at the rearward peripheral or sidewall surface of the projectile. The discharging gases from the relatively small pyrotechnic will exit along the conical wall of the launched spinning projectile and minimize the base drag effect of the environmental air stream during projectile flight.

3 Claims, 1 Drawing Figure

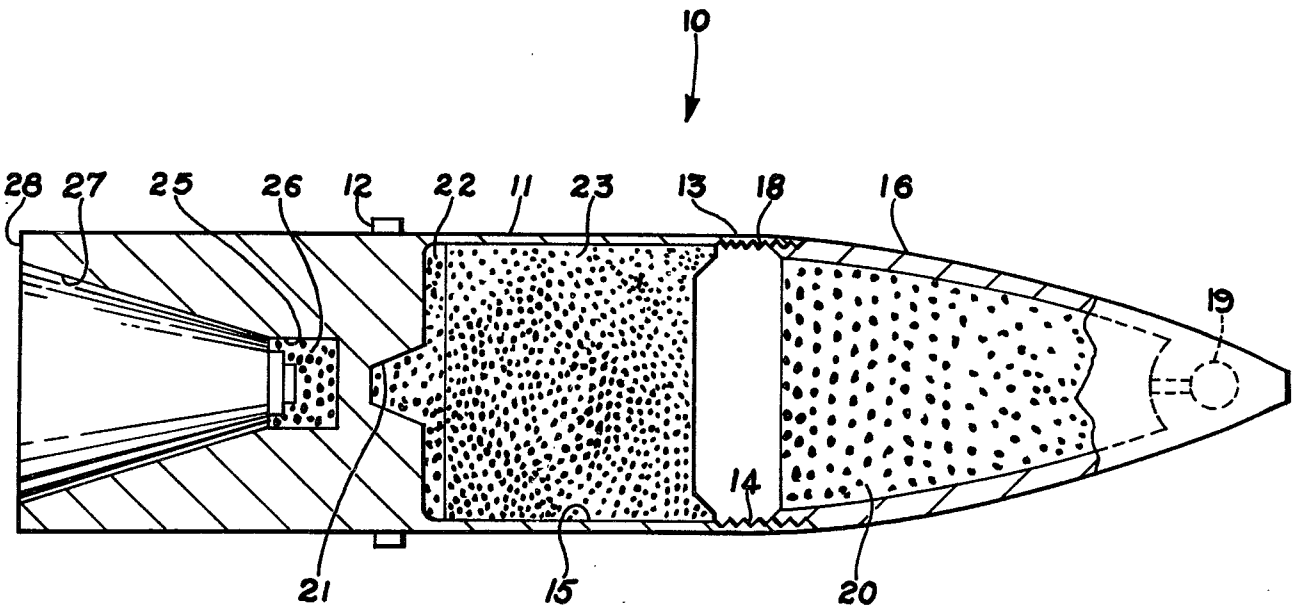
10
19
16
18
13
23
11
22
12
26
25
27
28
20
14
15
21

PROJECTILE

The invention described herein may be manufactured, used and licensed by or for the Government for governmental purposes without the payment to me of any royalty thereon.

In ammunition, especially large caliber, it has been found desirable to reduce the environmental air stream drag effect on launched projectiles to improve it's striking energy.

It is an object of the invention to provide a projectile requiring a minimum amount of pyrotechnic to minimize the drag effect of environmental air stream at the base of the projectile during its flight.

Another object of the invention is to provide such a projectile in which the pyrotechnic cavity can be press loaded or charged with pyrotechnic mix without the need for conventional brass funnels.

These and other objects, features and advantages will become more apparent from the following description and accompanying drawing which is substantially a longitudinal sectional view of a projectile embodying the principles of the invention.

The projectile, shown generally at 10, has a main body portion 11 provided with a substantially cylindrical peripheral surface containing a spin imparting rotating band 12, the body portion 11 having a converging tapered external wall portion 13 which terminates at the threaded mouth 14 of the forwardly opening cylindrical cavity 15 provided in the forward end of the body portion 11. A nose member 16 has a forwardly converging tapered external surface that aligns with body portion tapered surface when threadly secured to the body portion by its rearmost threaded cylindrical portion 18. The nose 16 preferably contains a point detonating fuze 19 and a high explosive incendiary mixture 20 in fluid communication therewith. The main body portion cavity base has a central conical recess 21 to seat an appropriately shaped igniter composition 22 rearwardly adjacent a self-destruct high explosive composition 23 suitably positioned in cavity 15. The rearward portion of the projectile main body has a relatively small, rearwardly opening cylindrical cavity 25 containing a pyrotechnic composition or fumer 26 for rearward emission of generated gas. The base of cavity 25 is located spacingly adjacent to igniter recess 21 to initiate the self-destruct high explosive 23 in flight should the projectile miss its target.

The rearmost edge of the cavity sidewall 25 intersects with an interconnecting rearwardly enlarging conical surface 27 that extends to the base 28 of the projectile adjacent the rearmost edge of the projectile cylindrical sidewall. The pyrotechnic cavity 25 has a diameter much smaller than that of the projectile main body portion and a longitudinal depth much shorter than the length of conical surface 27.

Upon launching of the spinning projectile by means not shown that also initiates the pyrotechnic 26, generated pyrotechnic gases swirl rearwardly in a spiral-like pattern along the conical surface to deliver hot combustion gases into the wake region or low pressure area at the base of the projectile close to the peripheral edge thereof.

Various modifications, changes or alterations may be resorted to without departing from the scope of the invention as set forth in the appended claims.

I claim:

1. A projectile comprising, a projectile main body having a forward nose portion secured to said main body, a substantially cylindrical peripheral wall portion, and a rearwardly opening cavity containing a pyrotechnic composition, said cavity having a substantially cylindrical sidewall, said cavity sidewall having a diameter substantially smaller than that of said peripheral wall portion, and a rearward portion of said projectile having means including an uninterrupted conical surface for interconnecting the rearmost surfaces of said main body and cavity sidewall, said uninterrupted conical surface defining an empty frusto-conical chamber rearward of said pyrotechnic composition.

2. The structure in accordance with claim 1 wherein the longitudinal distance between said rearmost surfaces is substantially greater than the longitudinal length of said cavity sidewall.

3. The structure according to claim 1 wherein said conical surface extends from the rearmost edge of said cavity sidewall to the base of said projectile adjacent said cylindrical sidewall.

* * * * *